US007259313B2

(12) United States Patent
Suzuki et al.

(10) Patent No.: US 7,259,313 B2
(45) Date of Patent: Aug. 21, 2007

(54) MUSICAL INSTRUMENT SYSTEM CAPABLE OF LOCATING MISSING REMOTE CONTROLLER, MUSICAL INSTRUMENT, REMOTE CONTROLLER AND METHOD USE THEREIN

(75) Inventors: Yoshitake Suzuki, Hamamatsu (JP); Toshio Yamayoshi, Hamamatsu (JP); Tadaharu Kato, Hamamatsu (JP); Yuji Fujiwara, Hamamatsu (JP); Tatsuya Makino, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 193 days.

(21) Appl. No.: 10/857,285

(22) Filed: May 28, 2004

(65) Prior Publication Data

US 2004/0261606 A1 Dec. 30, 2004

(30) Foreign Application Priority Data

Jun. 26, 2003 (JP) ..... 2003-182856

(51) Int. Cl.
*G10H 1/00* (2006.01)

(52) U.S. Cl. ..... 84/600; 84/477 R; 84/601; 84/634; 340/825.36

(58) Field of Classification Search ..... 84/600, 84/634, 601, 477 R, 115, 617; 340/825.36
See application file for complete search history.

(56) References Cited

U.S. PATENT DOCUMENTS 4,099,437 A * 7/1978 Stavrou et al. ..... 84/617
4,476,469 A * 10/1984 Lander ..... 340/825.49
5,790,021 A * 8/1998 Mickel et al. ..... 340/539.32
5,847,305 A * 12/1998 Yoshikawa et al. ..... 84/634
5,939,981 A * 8/1999 Renney ..... 340/539.32
5,945,918 A * 8/1999 McGonigal et al. ... 340/825.36
6,535,125 B2 * 3/2003 Trivett ..... 340/539.13
6,570,507 B1 * 5/2003 Lee et al. ..... 340/825.22
2002/0024449 A1 * 2/2002 Trivett ..... 340/825.49

FOREIGN PATENT DOCUMENTS

JP 7-322368 12/1995
JP 9-312891 12/1997
JP 11164170 A * 6/1999
JP 2000197160 A * 7/2000

* cited by examiner

*Primary Examiner*—Lincoln Donovan
*Assistant Examiner*—Christina Russell
(74) *Attorney, Agent, or Firm*—Morrison & Foerster LLP

(57) ABSTRACT

An electronic piano is controllable with a remote controller; since the remote controller is physically separated from the electronic piano, users are liable to mislay the remote controller somewhere around the electronic piano; in this situation, the user instructs the electronic piano to transmit a radio wave representative of inquiry, and the missing remote controller responds to the inquiry by transmitting a radio wave representative of annunciation; the electronic piano is equipped with antennas separated from each other on the piano cabinet, and the received power at the antennas is varied depending upon the location of the missing remote controller; the electronic piano analyzes the received power so as to notify the user of the possible location of the missing remote controller.

34 Claims, 9 Drawing Sheets

| RECEIVED POWER | POSSIBLE SUB-SPACE | PITCH OF TONE | DISTANCE |
|---|---|---|---|
| SGL>(K×SGR) | AGL | LK1 | SGL:<br>Far; ff<br>Middle; mf<br>Close; pp |
| (K×SGR)≧SGL>SGR | AGM | MK1 | |
| SGL≦SGR≦(K×SGL) | | | SGR:<br>Far; ff<br>Middle; mf<br>Close; pp |
| (K×SGL)<SGR | AGR | HK1 | |

Fig. 5

MUSICAL INSTRUMENT SYSTEM CAPABLE OF LOCATING MISSING REMOTE CONTROLLER, MUSICAL INSTRUMENT, REMOTE CONTROLLER AND METHOD USE THEREIN

FIELD OF THE INVENTION

This invention relates to locating technologies and, more particularly, to a musical instrument system with a remote controller, the remote controller and a method for locating a missing remote controller.

DESCRIPTION OF THE RELATED ART

An electronic keyboard musical instrument includes a keyboard, an array of key switches, a tone generator and a data processor. The array of black and white keys, i.e., keyboard is monitored with the array of key switches. While a player is fingering on the keyboard, the array of key switches informs the data processor of the depressed keys and released keys, and the data processor requests the tone generator to produce and delay electronic tones for the depressed/released keys. This is the fundamental function of the electronic keyboard musical instrument.

The manufacturers have expanded the capability of the electronic key-board musical instrument. Recently, several sorts of the electronic keyboard musical instrument have a recording function and a playback function. A player is assumed to instruct the electronic keyboard musical instrument to record his or her performance. While the player is fingering a piece of music on the keyboard, the data processor produces music data codes representative of the key action, and supplies the music data codes to a memory in parallel to the tone generator. Thus, the electronic keyboard musical instrument accumulates the pieces of music data information concurrently with the production of the electronic tones. On the other hand, when the player wishes to play the piece of music back, he or she instructs the electronic keyboard musical instrument to read out the music data codes and supply them to the tone generator. While the data processor is sequentially transferring the music data codes to the tone generator, the tone generator produces an audio signal from the pieces of waveform data, and supplies the audio signal to the speaker system for producing the electronic tones. Thus, the electronic keyboard musical instrument is responsive to not only the fingering on the keyboard but also the requests for the recording and playback.

The instructions are usually given to the electronic keyboard musical instrument through a manipulating panel provided on the cabinet. However, some users want to control the electronic keyboard musical instrument through a remote controller. The remote controller is physically separated from the electronic keyboard musical instrument, and the users communicate with the electronic keyboard musical instrument through a radio system. The radio system is convenient to those users. However, the users are liable to mislay the remote controller somewhere. When the user can not find the remote controller, he or she is frustrated.

In order to assist the users to find the missing remote controller, an answering capability is given to electric/electronic goods and their remote controller as disclosed in Japanese Patent Application laid-open No. Hei 9-312891. The prior art answering system behaves as follows. When a user turns on the power switch, the electric/electronic goods radiate a radio call signal. The radio call signal reaches the remote controller. Then, the remote controller produces a ringing tone. Even if the user mislays the remote controller somewhere, he or she can locate the missing remote controller by tracing the ringing tone.

Another example of the answering system is disclosed in Japanese Patent Application laid-open No. Hei 7-322368. The prior art answering system behaves as follows. When a user can not find the remote controller, the user instructs the electronic goods to radiate a search signal. The search signal reaches the missing remote controller, and activates a vibrator, which is built in the remote controller. The vibrator gives rise to vibrations so that the user can locate the origin of vibrations, i.e., the missing remote controller.

However, a problem is encountered in the prior art answering systems in that users merely know that the missing remote controller is near them. This means that the users have to look for the missing remote controller around them. Especially, when the electric/electronic goods are in a small room, the ringing tone and vibrations tend to be echoed, and the users feel it difficult to find the missing remote controller. If the missing remote controller is covered with a cushion or the like, the answer does not reach the users so that the users can not find the missing remote controller. Moreover, in case where the answer does not reach the users, the users can not reason the silence, because the missing remote controller may be out of the room or covered with the cushion.

SUMMARY OF THE INVENTION

It is therefore an important object of the present invention to provide a musical instrument system, which exactly locates a missing remote controller.

It is another important object of the present invention to provide a musical instrument, which teaches a user an area where a missing remote controller is to be found.

It is still another important object of the present invention to provide a remote controller, which permits the musical instrument to specify the area where it is.

It is yet another important object of the present invention to provide a method for determining an area where the missing remote controller is.

To accomplish the object, the present invention proposes to analyze an annunciation supplied from a remote controller for determining a possible location.

In accordance with one aspect of the present invention, there is provided a musical instrument system for producing music sound comprising a remote controller outputting instructions for a behavior and an annunciation representative of a present location to the outside thereof, and a musical instrument physically separated from the remote controller and including a sound generator for producing the music sound, an electric system responsive to the instructions so as to assist the sound generator in at least producing the music sound and analyzing the annunciation for locating the remote controller in a space around the musical instrument and an information provider connected to the electric system and notifying users of a possible location of the remote controller.

In accordance with another aspect of the present invention, there is provided a musical instrument controllable with a remote controller physically separated therefrom comprising a sound generator for producing music sound, an electric system responsive to instructions for a behavior of the musical instrument so as to assist the sound generator in at least producing the music sound and analyzing an annunciation supplied from the remote controller for locating the remote controller in a space around the musical instrument, and an information provider connected to the electric system and notifying users of a possible location of the remote controller.

In accordance with yet another aspect of the present invention, there is provided a remote controller physically separated from and communicable with a musical instrument for controlling a behavior of the musical instrument, and the remote controller comprises a signal generator producing a first signal representative of instructions for the behavior and a second signal representative of an annunciation indicative of a present location and a transmitter connected to the signal generator and responsive to the first signal and the second signal for informing the musical instrument of the instructions and the annunciation.

In accordance with still another aspect of the present invention, there is provided a method for locating a remote controller in a space around a musical instrument comprising the steps of a) receiving an annunciation indicative of a present location of the remote controller, b) analyzing a physical quantity represented by the annunciation in terms of directions around the musical instrument for determining a possible location of the remote controller, and c) notifying a user of the possible location of the remote controller.

BRIEF DESCRIPTION OF THE DRAWINGS

The features and advantages of the musical instrument system, musical instrument, remote controller and method will be more clearly understood from the following description taken in conjunction with the accompanying drawings, in which FIG. 5 is a view showing a relation between received power at both antennas and a possible location of the missing remote controller.

DESCRIPTION OF THE PREFERRED EMBODIMENTS

First Embodiment

Figure 1:
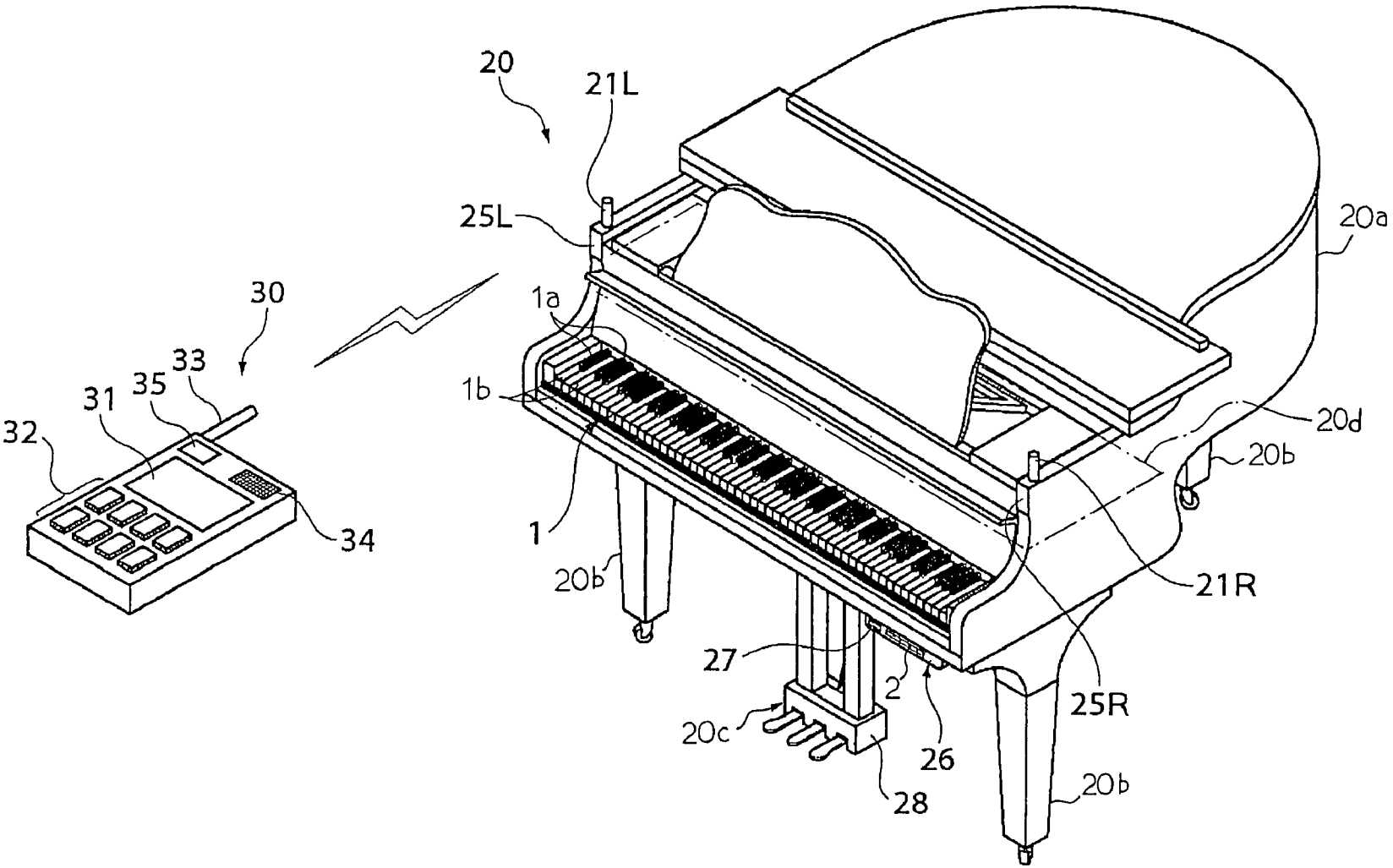
FIG. 1 is a perspective view showing a musical instrument system according to the present invention.

Referring first to FIG. 1 of the drawings, a keyboard musical instrument system embodying the present invention largely comprises an electronic piano 20 and a remote controller 30. While a pianist is fingering a piece of music on the electronic piano 20, electronic tones are radiated from the electronic piano 20 along the music passage. Although the remote controller 30 is physically separated from the electronic piano 20, users are communicable with the electronic piano 20 through the remote controller 30. Thus, the electronic piano 20 is controllable with the remote controller 30. Component parts labeled with reference characters 25L and 25R are discussed below with reference to FIG. 4. Component parts 31 to 35 of the remote controller 30 are discussed below with reference to FIG. 3.

In the following description, term "front" is indicative of a position closer to the player, who is ready for performance on the electronic piano 20, than a position modified with term "rear". Term "fore-and-aft" is indicative of the direction of a line drawn between a front position and a corresponding rear position, and term "lateral" is indicative of a direction crossing the fore-and-aft direction at right angle.

The electronic piano 20 has a contour like a grand piano, and includes a keyboard 1, a piano cabinet 20*a*, legs 20*b*, a pedal system 20*c* and an electronic system 20*d*. Black keys 1*a* and white keys 1*b* are essential parts of the keyboard 1, and are laid on the well-known pattern. The legs 20*b* downwardly projects from the piano cabinet 20*a*, and keep the piano cabinet 20*a* over a floor. The pedal system 20*c* is hung from the piano cabinet 20*a*, and the pianist selectively steps on the pedals for imparting effects to the electronic tones. The electronic system 20*d* is housed in the piano cabinet 20*a*. The black keys 1*a*, white keys 1*b* and pedals are connected to the electronic system 20*d* so that the electronic system 20*d* is responsive to the key action and pedal action for generating the electronic tones. The electronic system 20*d* is further responsive to user's instructions given through the remote controller 30 so as to change the behavior or modes of operation.

Figure 2:
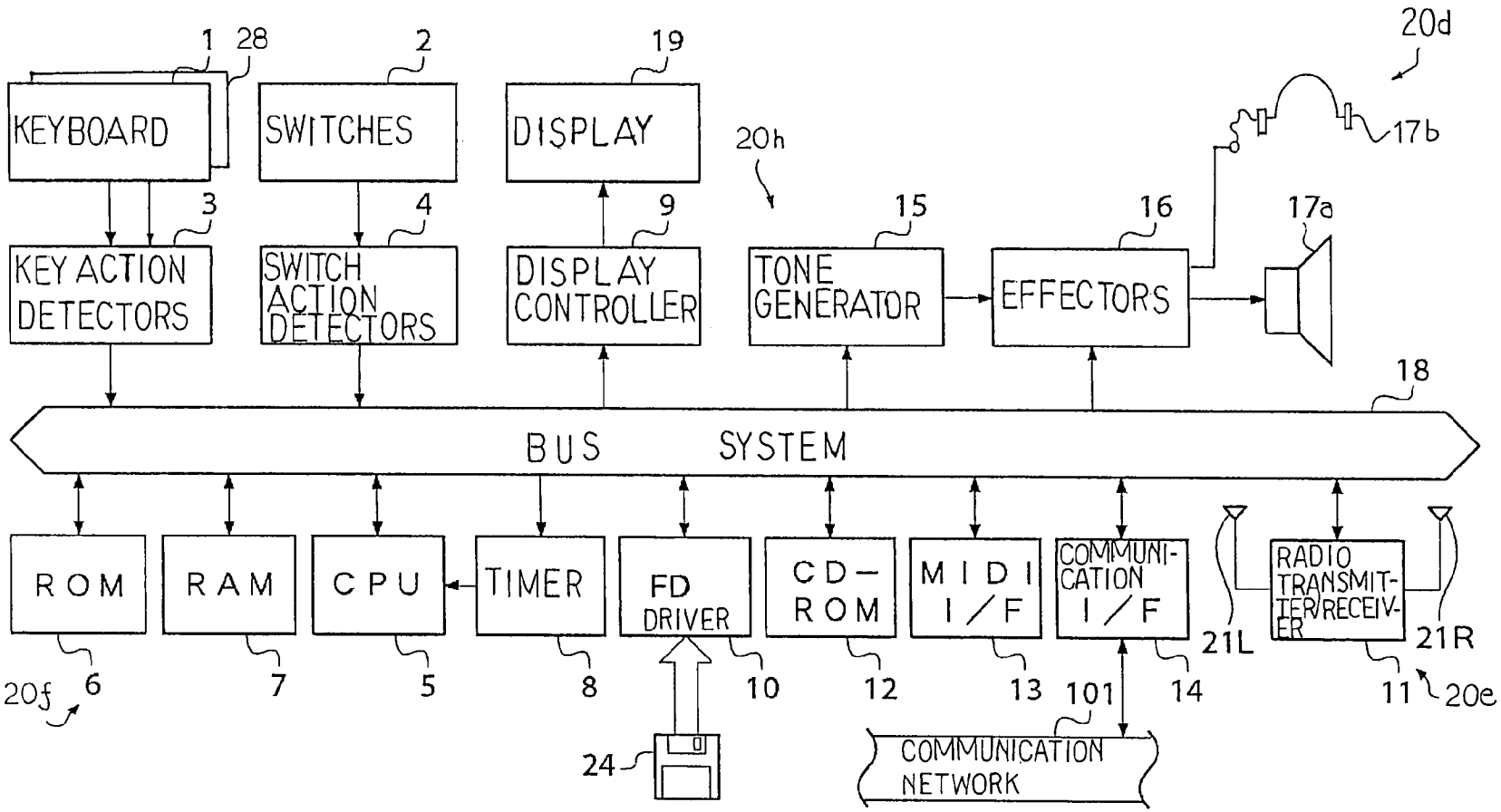
FIG. 2 is a block diagram showing the system configuration of an electronic system incorporated in an electronic piano of the musical instrument system.

The electronic system 20*d* is illustrated in FIG. 2. The system components are broken down into an interface 20*e*, a data processing sub-system 20*f* and a tone generating sub-system 20*h*. The interface 20*e*, data processing sub-system 20*f* and tone generating sub-system 20*h* are connected to a shared bus system 18, and pieces of data are transferred among the interface 20*e*, data processing sub-system 20*f* and tone generating sub-system 20*h* through the shared bus system 18. The interface 20*e* is provided between the shared bus system 18 and external devices such as, for example, a display unit 19, a floppy disk (trademark) 24, a CD-ROM (Compact-Disk Read Only Memory), a manipulating panel 26 (see FIG. 1), the remote controller 30 (see FIG. 1), a MIDI musical instrument (not shown) and a communication network 101. A LCD (Liquid Crystal Display) panel may serve as the display unit 19, and a server computer (not shown) may be connected to the communication network 101. The data processing sub-system 20*f* receives pieces of data from the external devices through the interface 20*e*, and transfers pieces of data to the external devices. Tasks to be achieved by the data processing sub-system 20*f* will be hereinlater described. The data processing system 20*f* supplies pieces of music data through the shared bus system 18 to the tone generating sub-system 20*h*, and the tone generating sub-system 20*h* produces the electronic tones on the basis of the pieces of music data. The interface 20*e*, data processing sub-system 20*f* and tone generating sub-system 20*h* are hereinafter described in detail.

The interface 20*e* includes a key action detectors 3, a switch action detectors 4, a display driver 9, a floppy disc controller/driver 10, a radio transmitter/receiver 11, a CD-ROM driver 12, a MIDI interface 13 and a communication interface 14. These are connected to the shared bus system 18, and behave as follows.

The key action detectors 3 are provided in association with the black/white keys 1*a*/1*b* and pedal switches 28, and produce key/pedal status signals each representative of key-on/pedal-on state or key-off/pedal-off state of the associated key/pedal 1*a*/1*b*/28. The pedal switches 28 are provided in a lyre box (see FIG. 1), and respectively monitor the pedals to see whether or not the pianist steps on any one of the pedals. The data processing sub-system 20*f* periodically checks the key action detectors 3, and fetches the key/pedal status signals. The data processing sub-system 20*f* analyzes the pieces of key/pedal status data, and determines the current key state and current pedal state. The data processing sub-system 20*f* produces pieces of music data, which represent a performance on the keyboard 1 and pedal system 20*c*, on the basis of the current key status and current pedal status, and the pieces of music data are coded as music data codes such as, for example, MIDI music data codes.

The switches 2 are provided on the manipulating panel 26 together with a power switch 27 (see FIG. 1). Users give instructions to the data processing sub-system 20*f* by selectively manipulating the switches 2, and the switch action detectors 4 produce the switch status signals each representative of the open state or closed state of the associated switch 2. Some switches are called as "mode switches", and users selectively establish a standard tone generation mode, a mute mode, a recording mode, a playback mode, a data transfer mode and so forth in the electronic piano 20. The volume control is assigned to another switch, and the users make the floppy disk controller/driver 10, CD-ROM driver 12, MIDI interface 13 and communication interface 14 enabled by manipulating other switches 2.

Pieces of image data are supplied from the data processing sub-system 20*f* to the display controller 9. The display controller 9 produces an image carrying signal representative of images to be produced on the display unit 19, and sweeps the screen of the display unit 19 with the image carrying signal. This results in visual images produced on the display unit 19. A music score is an example of the visual images. Though not shown in FIG. 1, the display unit 19 may be put on the piano cabinet 20*a* on either side of the music rack.

The floppy disk controller/driver 10 writes pieces of music data in and reads the pieces of music data from the floppy disk 24. Control/application programs and pieces of data are stored in another floppy disk, and have been transferred to the data processing sub-system 20*f*. While a pianist is fingering a music passage on the keyboard 1 in the recording mode, the data processing sub-system 20*f* produces pieces of music data representative of the performance, and the piece of music data are stored in the floppy disk 24 through the floppy disk controller/driver 10.

The CD-ROM driver 12 reads out pieces of music data from a compact disk (not shown) in the playback mode, and the pieces of music data are transferred to the tone generating sub-system 20*h* for producing the electronic tones. The control/application programs and pieces of data may be transferred from another compact disk to the data processing sub-system 20*f*.

The MIDI interface 13 is connectable to a MIDI instrument (not shown) such as, for example, a MIDI musical instrument. The MIDI data codes are supplied from the data processing sub-system 20*f* to and from the MIDI instrument through the MIDI interface 13.

The communication interface 14 is connectable to the communication network 101. A server computer may be connected to the communication network 101. The data processing sub-system 20*f* supplies the pieces of music data through the communication network 101 to a designation in the data transfer mode, and pieces of music data, which represents a performance, are received through the communication network also in the data transfer mode and playback mode.

In summary, the electronic piano 20 is responsive to the fingering on the keyboard 1 in the standard tone generation mode for radiating the electronic tones in the ambience. When the user selects the mute mode, the user privately hears the electronic tones without disturbance to the neighborhood. Pieces of music data, which represent the performance on the keyboard 1, are stored in a memory such as the floppy disk 24 in the recording mode. Pieces of music data are read out from a memory such as the floppy disk 24 or compact disc in the playback mode so that the electronic piano 20 plays a performance back. The pieces of music data may be supplied from a data source through the communication network 101 in the playback mode. The pieces of music data are transferred to and from another MIDI musical instrument or communication network 101 in the data transfer mode. There is another mode of operation, which is called as "remote controller locating mode". When a user requests the electronic system 20*d* to locate the remote controller 30, the electronic system 20*d* enters the remote controller locating mode, and determines an area where the remote controller 30 is to be found.

The radio transmitter/receiver 11 is connected to a left antenna 21L and a right antenna 21R, and communicates with the remote controller 30 through these antennas 21L/21R. The left and right antennas 21L/21R are provided on the piano cabinet 20*a* at the leftmost position and the rightmost position as shown in FIG. 1. The radio transmitter/receiver 11 communicates with the remote controller 30, and the radio system of the radio transmitter/receiver 11 is designed on the basis of the IEEE (Institute of Electrical and Electronic Engineers), 802.11b. The radio transmitter/receiver 11 radiates a radio wave representative of an inquiry from the left and right antennas 21L/21R in the remote controller locating mode, and receives a radio wave representative of user's instructions and another radio wave representative of an annunciation at the left and right antennas 21L/21R. The radio wave representative of user's instructions is transmitted from the remote controller 30 upon manipulation of the remote controller 30 by the user, and the radio wave representative of the annunciation is transmitted from the remote controller 30 in the remote controller locating mode in response to the radio wave representative of the inquiry.

The data processing sub-system 20*f* includes a central processing unit 5*m* a read only memory 6, a random access memory 7 and a timer 8. The central processing unit 5*m* may be given as a monolithic microprocessor. The central processing unit 5, read only memory 6 and random access memory 7 are respectively abbreviated as "CPU, "ROM" and "RAM" in FIG. 2. In this instance, both volatile and non-volatile memory devices are incorporated in the random access memory 7. A semiconductor random access memory device is a typical example of the volatile random access memory device, and a hard disc is an example of the non-volatile memory device. The timer measures the lapse of time, and gives the timing for a timer interruption to the central processing unit 5.

An operating system and data tables are stored in the read only memory 6, and the random access memory 7 offers address spaces to control/application programs and pieces of data. The control/application programs have been transferred from the floppy disk 24 or CD-ROM to the random access memory 7. The control/application programs are organized into a computer program on which the central processing unit 5 runs, and the computer program includes a main routine program, conditional sub-routine programs and a timer-interruption sub-routine program.

The tone generating sub-system 20*h* includes a tone generator 15, effectors 16, a sound unit (not shown), loud speakers 17*a* and a headphone 17*b*. The sound unit (not shown) includes a digital-to-analog converter for converting a digital audio signal to an analog audio signal, and equalizes and amplifies the analog audio signal. The sound unit supplies the analog audio signal to the loud speakers 17*a* or both of the loud speakers 17*a* and the headphone 17*b*. Thus, the pianist enjoys his performance together with the audience in the standard tone generation mode. On the other hand, when the mute mode is established in the electronic piano 20, the sound unit (not shown) supplies the audio signal to the headphone 17*b* so that the pianist can hear the electronic tones without disturbance to the neighborhood.

Figure 3:
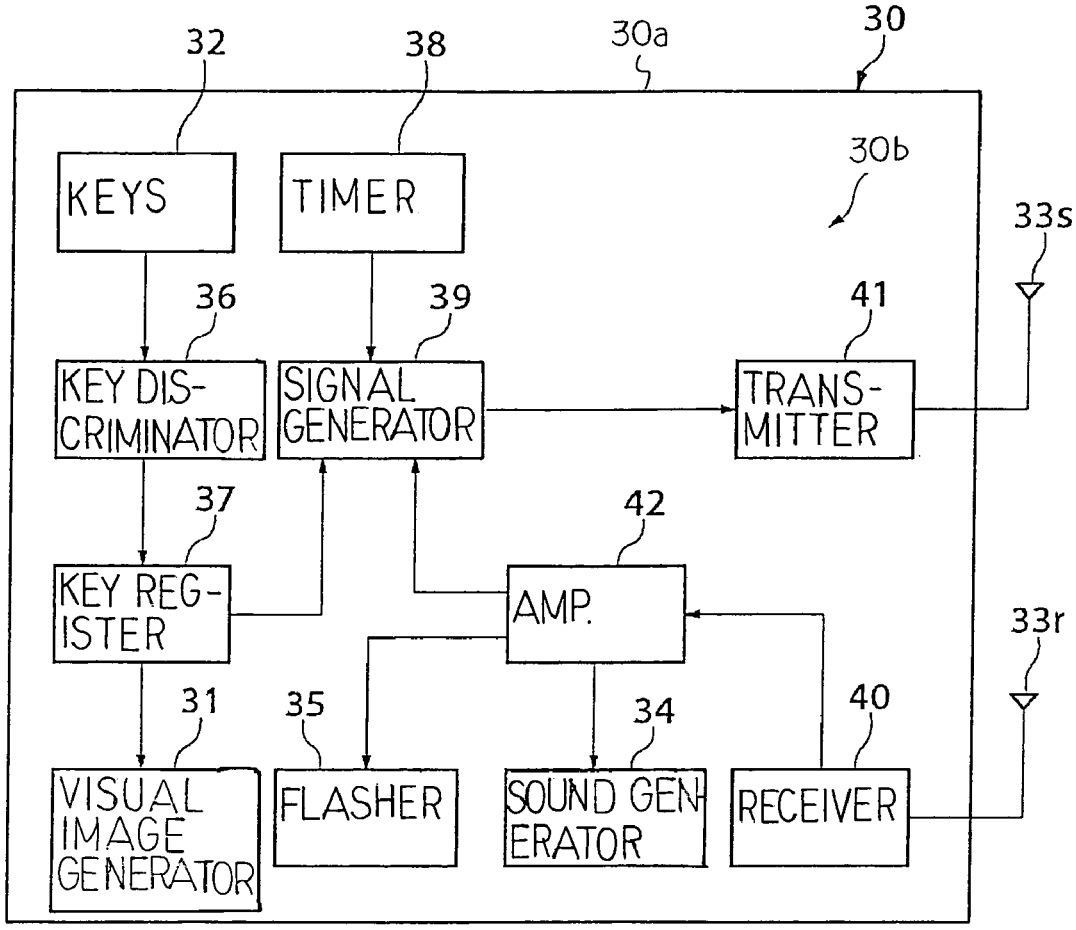
FIG. 3 is a block diagram showing the circuit configuration of an electric circuit incorporated in a remote controller.

Turning to FIG. 3 of the drawings, the remote controller 30 has a case 30*a* and a circuit board 30*b*. The circuit board 30*b* is housed in the case 30*a*, and a visual image generator 31, keys 32, an antenna 33 or antennas 33*s*/33*r*, a sound generator 34 and a flasher 35 are provided on the case 30*a*. The keys 32 are corresponding to selected ones of the keys 2. Some keys 32 are assigned to the modes of operation, i.e., the recording mode, mute mode, play-back mode and data transfer mode, and the volume control, start, interrupt, quick traverse, quick reverse etc. are assigned to other keys 32.

Users give their instructions to the electric piano 20 by selectively de-pressing the keys 32, and the remote controller 30 transmits the ratio wave representative of the user's instructions from the antenna 33*s* to the electronic piano 20. Visual images, which represent the user's instructions, are produced through the visual image generator 31 so that the users can confirm their instructions through the visual images. On the other hand, when the radio wave representative of the inquiry reaches the antenna 33*r*, the remote controller 30 answers with the radio wave representative of the annunciation, and causes the flasher 35 to be flickered and the sound generator 34 to radiate advisory sound.

A key discriminator 36, a key register 37, a timer 38, a signal generator 39, a receiver 40 and a transmitter 41 are mounted on the circuit board 30*b*. The key discriminator 36 is connected to the keys 32, and is further connected to the key register 37 and the signal generator 39. The key discriminator 36 monitors the keys 32 to see whether or not a user manipulates any one of the keys 32. Upon determination of the manipulated key 32, the key discriminator 36 supplies an instruction code representative of the job to be achieved to the key register 37 so that the instruction code is stored in the key register 37.

The key register 37 is connected to the visual image generator 31 and signal generator 39, and supplies the instruction code to those circuit components 31 and 37. The visual image generator 31 is responsive to the instruction code so as to produce a visual image or images representative of the job on the screen. The signal generator 39 is also responsive to the instruction code so as to produce an output signal representative of the jobs to be achieved.

The signal generator 39 is connected to the transmitter 41, and the output signal is supplied to the transmitter 41 under the control of the timer 38. The transmitter 41 produces the radio wave on which the output signal is carried, and the radio wave is radiated from the antenna 33*s*. The radio wave reaches the antennas 21L/21R, and is demodulated from the radio wave to the instruction code in the radio transmitter/receiver 11. Thus, the user gives the instruction through the remote controller 30 to the electronic system 20*d*.

The user is assumed to depress the key 32 indicative of the playback mode. The key discriminator 36 produces the instruction code representative of the playback mode, and the instruction code is transferred through the key register 37 to the signal generator 39. The signal generator 39 supplies the output signal representative of the user's instruction, i.e., the playback mode, and the user's instruction is transmitted from the transmitter 41 through the radio wave to the radio transmitter/receiver 11, and the user's instruction is produced from the radio wave. The instruction code is fetched by the central processing unit 5 so that the electronic piano 20 is established in the playback mode.

When the radio wave representative of the inquiry arrives at the antenna 33*r*, the radio wave is demodulated to an input signal representative of the inquiry. The receiver 40 is connected to an amplifier 42 so that the input signal is supplied to the amplifier 42. The input signal is amplified. The amplifier 42 is connected to the sound generator 34, flasher 35 and signal generator 39 so that the input signal is distributed to the sound generator 34, flasher 35 and signal generator 39.

The sound generator 34 is responsive to the input signal so as to generate the advisory sound. The flasher 35 is also responsive to the input signal so as to radiate light repeatedly. If the remote controller 30 is close to the user, the user notifies the light and/or advisory sound, and easily finds the remote controller 30.

The input signal, which reaches the signal generator 39, gives rise to the annunciation. In detail, when the input signal reaches the signal generator 39, the signal generator 39 produces another output signal representative of the annunciation, and supplies it to the transmitter 41. The transmitter 41 produces the radio wave representative of the annunciation, and radiates it from the antenna 33*s*. The radio wave reaches the antennas 21L/21R, and is de-modulated to an annunciation signal. The annunciation signal or annunciation code is fetched by the central processing unit 5, and the main routine program branches to the sub-routine program for locating the remote controller as will be hereinlater described in detail.

Figure 4:
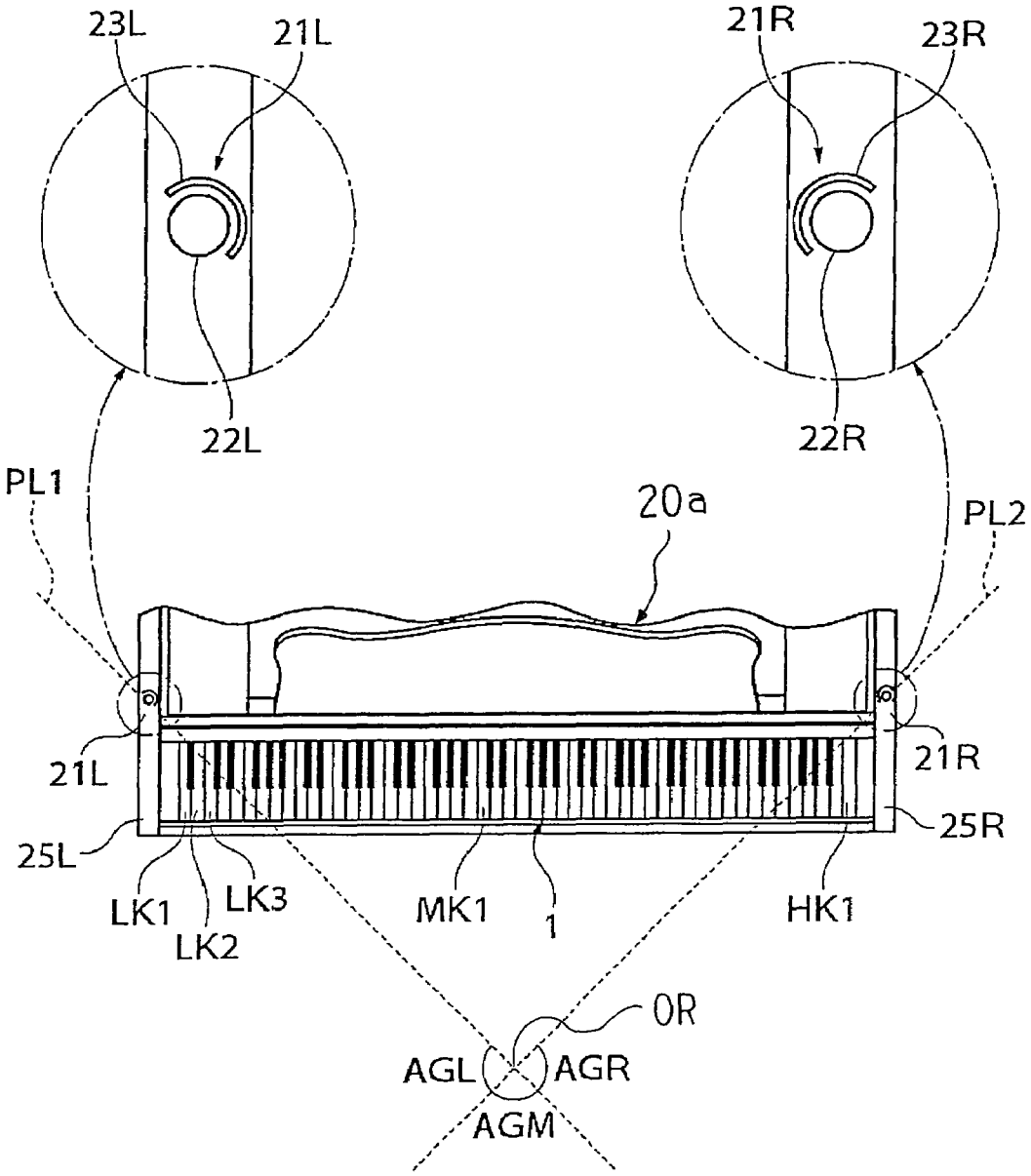
FIG. 4 is a schematic view showing possible sub-spaces where a missing remote controller is to be found.

Turning to FIG. 4 of the drawings, references "25L" and "25R" are indicative of a left wall portion and a right wall portion of a side board, which forms a part of the piano cabinet 20*a*. The left antenna 21L and right antenna 21R stand on the left wall portion 25L and right wall portion 25R, respectively. The antenna 21L well radiates the radio wave and capture it propagated through the space in front of a virtual line PL1, and the other antenna 21R radiates the radio wave and capture it propagated through the space in front of a virtual line PL2, respectively. However, if the radio waves are radiated on the opposite side of the virtual lines PL1 and PL2, the radio waves are weakened. Thus, the left antenna 21L and right antenna 21R have a directivity.

The left antenna 21L includes an antenna pole 22L and a shield wall 23L. The antenna pole 22L is vertical to the upper surface of the left wall portion 25L, and the shield wall 23L has a contour like a half-pipe. The shield wall 23L is spaced from the antenna pole 22L, and is confronted with the side surface of the antenna pole 22L from the left side of the rear space to the right side of the front space over about 180 degrees in the clockwise direction. For this reason, the radio wave reaches the antenna pole 22L through the space in front of the virtual line PL1.

The right antenna 21R also includes an antenna pole 22R and a shield wall 23R. The antenna pole 22R is vertical to the upper surface of the right wall portion 25R, and the shield wall 23R also has the contour like the half-pipe. The shield wall 23R is spaced from the antenna pole 22R, and is confronted with the side surface of the antenna pole 22R from the right side of the rear space to the left side of the front space over about 180 degrees in the counter clockwise direction. For this reason, the radio wave reaches the antenna pole 22R through the space in front of the virtual line PL2.

The virtual line PL1 crosses the other virtual line PL2 at OR, and the space is divisible into four sub-spaces, which are labeled with "AGL", "AGM" and "AGR" except for the sub-space confronted with the sub-space AGM. A user is assumed to radiate the radio wave representative of the annunciation from the antenna 33*s*, which is directed to the electronic piano 20. The radio wave, which is propagated through the sub-space AGL, is well captured by the antenna 21L. However, the radio wave is hardly captured by the other antenna 21R. On the other hand, the radio wave, which is propagated through the sub-space AGR, is well captured by the antenna 21R, and is hardly captured by the other antenna 21L. The radio wave, which is propagated through the sub-space AGM, is evenly captured by both antennas 21L and 21R. Thus, the missing remote controller 30 is locatable through the comparison of the received power at the antennas 21L/21R.

Description is hereinafter made on the behavior of the electronic piano 20 with reference to FIGS. 1 to 4. The computer program is broken down into the main routine program, two conditional sub-routine programs and a timer interruption sub-routine program. When the electronic system 20*d* is powered, the central processing unit 5 starts to execute the main routine program. The central processing unit 5 reiterates the main routine program until the electric power is removed from the electronic system 20*d*. While the central processing unit 5 is reiterating the main routine, the main routine program periodically branches to the timer interruption sub-routine program for producing music data codes representative of a performance on the keyboard 1, and data source/ destination flags are set for the music data code or codes. The data source flag is indicative of a data source where the data codes to be transferred are stored, and the destination flags is indicative of a destination to which the data codes are to be transferred. One of the conditional sub-routine programs is prepared for the data transfer of the music data codes from the random access memory 7 to the tone generator 15, MIDI interface 13, floppy disk controller 49 driver 10 or communication interface 14. The destination is depending on the mode of operation selected by the user. The other conditional sub-routine program is prepared for the remote controller locating mode. The central processing unit 5 locates the missing remote controller through this sub-routine program. The main routine program, timer interruption program and conditional sub-routine programs are hereinafter described in detail.

The central processing unit 5 achieves several tasks during the execution of the main routine program. First, the central processing unit 5 initializes the electronic system, and reiterates the execution loop, which includes the following steps.

The central processing unit 5 checks the switch action detectors 4 to see whether or not the user manipulates any one of the switches 2 so as to give an instruction to the electronic system 20*d*. If the answer is given negative, the central processing unit 5 proceeds to the next step. On the other hand, when the user manipulates a certain key 2, the central processing unit 5 determines the manipulated key 2, and interprets the instruction given by the user. If the manipulated key 2 is indicative of a certain mode of operation, the central processing unit 5 sets a corresponding mode flag and source/destination flags representative of the data source and destination of the music data codes. If the manipulated key 2 is indicative of a certain tone color, increase or decrease of the volume or a certain effect, the central processing unit produces a control data code representative of the tone color, increase or decrease of the volume or certain effect, and stores the control data code in the random access memory 7. The central processing unit 5 further produces other control data codes representative of a message to be produced on the display unit 19, if necessary, and stores the control data codes in the random access memory 7. Thus, the central processing unit 5 communicates with the manipulating panel 26, and prepares the electronic system 20*d* for the given instruction.

Subsequently, the central processing unit 5 checks the radio transmitter/receiver 11 to see whether or not the user gives any instruction through the remote controller 30. If the answer is given negative, the central processing unit 5 proceeds to the next step. On the other hand, if the answer is given affirmative, the central processing unit 5 selectively sets the flags, and produces the control data codes as similar to the previous step. Thus, the central processing unit 5 communicates with the remote controller 30, and prepares the electronic system 20*d* for the given instruction.

Subsequently, the central processing unit 5 checks the random access memory 7 to see whether or not the control data code or codes have been already stored therein. If the answer is given negative, the central processing unit 5 proceeds to the next step. On the other hand, when the central processing unit 5 finds the control data codes, the central processing unit 5 transfers the control data codes to the tone generator 15, effectors 16 and sound unit (not shown) so as to change the tone color, volume and effects from the default values to the given values. For example, in case where the user selects the mute mode, the control data code is supplied to the sound unit (not shown), and makes the sound unit block the loud speakers from the audio signal. Thus, the central processing unit 5 prepares the tone generating sub-system 20*h* for performances.

Subsequently, the central processing unit 5 checks the random access memory 7 to see whether or not the data source/destination flags have been already set. If the answer is given negative, the central processing unit 5 proceeds to the next step. If the answer is given affirmative, the central processing unit 5 further checks the data source to see whether or not the music data codes have already gotten ready for the data transfer. Moreover, the central processing unit 5 further checks the destination flag to see whether or not the destination has already gotten ready for the data reception. If both answers are given affirmative, the central processing unit 5 transfers the music data code or codes presently ready for the data transfer from the data source to the destination. The random access memory 7, tone generator 15, floppy disk controller/driver 10, CD-ROM driver 12, MIDI interface 13 and communication interface 14 selectively serve as the data source and destination. When the electronic piano is established in the standard tone generation mode, the music data codes are transferred from the random access memory 7 to the tone generator 15, and the electronic tones are radiated from the loud speakers 17*a*. When the electronic piano is established in the mute mode, the music data codes are transferred from the random access memory 7 to the tone generator 15, and the electronic tones are radiated from the headphone 17*b*. When the electronic piano is established in the recording mode, the music data codes are transferred from the random access memory 7 to the floppy disk controller/driver 10, and the music data codes are stored in a floppy disk 24. When the electronic piano is established in the playback mode, the music data codes are transferred from the random access memory 7, to which the music data codes have been already transferred from the floppy disk controller/driver 10, CD-ROM controller 12, MIDI interface 13 or communication interface 14, to the tone generator 15, or the music data codes are directly transferred to the tone generator 15. When the electronic piano is established in the data transfer mode, the music data codes are transferred between any two of the random access memory 7, floppy disk controller/driver 10, CD-ROM controller 12, MIDI interface 13 and communication interface 14. When the electronic piano is established in the remote controller locating mode, the music data codes are transferred from the random access memory 7 to the tone generator 15, and the control data code representative of a certain loudness is transferred from the random access memory 7 to the sound unit (not shown). The tone generator 15 generates the audio signal representative of the tone to be produced at the pitch equal to that of the pitch name assigned to the white key LK1, MK1 or HK1. Thus, the electronic system 20*d* notifies the user of the location of the missing remote controller through the electronic tone at the certain loudness.

Subsequently, the central processing unit 5 checks the mode flag to see whether or not the user requests the electronic system 20*d* to locate the missing remote controller 30. If the answer is given negative, the central processing unit 5 proceeds to the next step. If, on the other hand, the answer is given affirmative, the central processing unit 5 enters the conditional sub-routine program. The remote controller locating mode is hereinafter described in more detail.

Although the timer interruption periodically occurs, the central processing unit 5 immediately returns to the main routine before the user does not start his or her performance on the keyboard 1.

While the central processing unit 5 is reiterating the loop of the main routine program, the user is assumed to start his or her performance. When the timer interruption occurs, the main routine program branches to the timer interruption sub-routine program, and the central processing unit firstly checks the key action detectors 3 to see whether or not the user depresses or releases any one of the black/white keys 1*a*/1*b* and/or any one of the pedals of the pedal system 20*c*. The central processing unit 5 compares the current key/pedal status with the previous key/pedal status, and determines a note-on event and/or note-off event, if any. The central processing unit 5 produces the music data codes representative of the note-on event, note-off event and/or the effect to be imparted to the electronic tones. The central processing unit 5 stores the music data codes in the random access memory 7, and sets the data source/destination flags. Upon completion of the jobs, the central processing unit 5 returns to the main routine program, and the music data codes are transferred from the random access memory 7 to the destination through the conditional sub-routine program for the data transfer.

Assuming now that the user requests the electronic system 20*d* to locate the missing remote controller 30, the central processing unit 5 sets the mode flag representative of the remote controller locating mode, and enters the sub-routine program. In this instance, the user concurrently depresses the white keys LK1/LK2/LK3, and turns on the power switch 27 without releasing the white keys LK1/LK2/LK3. Then, the central processing unit 5 acknowledges the remote controller locating mode, and sets the corresponding mode flag.

Upon entry into the conditional sub-routine program, the central processing unit 5 supplies a control data code representative of the inquiry to the radio transmitter/receiver 11. The radio transmitter/receiver 11 produces the radio wave representative of the inquiry on the basis of the control data code, and the radio wave is transmitted from the antennas 21L/21R. The radio wave representative of the inquiry is received at the antenna 33*r*, and is de-modulated to the input signal by means of the receiver 40. The input signal causes the sound generator 34 to radiate the advisory sound, and the flasher 35 to intermittently radiate the light. If the advisory sound and light draw the user's attention to the remote controller 30, the user immediately locates the missing remote controller 30, and picks up the remote controller.

The input signal further causes the signal generator 39 to supply the output signal representative of the annunciation to the transmitter 41, and the transmitter 41 transmits the radio wave representative of the annunciation from the antenna 33*s* toward the electronic piano.

The radio wave is captured at the antennas 21L/21R, and the radio transmitter/receiver 11 demodulates the radio wave at the left antenna 21L and the ratio wave at the right antenna 21L to a left annunciation signal and a right annunciation signal, respectively. The left annunciation signal and right annunciation signal are respectively converted to control data codes representative of the magnitude of the left annunciation signal and the magnitude of the right annunciation signal, and the central processing unit 5 fetches the control data codes.

In the following description, "SGL" and "SGR" (see FIG. 5) stand for a binary number of the control data code representative of the magnitude of the left annunciation signal and a binary number of the control data code representative of the magnitude of the right annunciation signal, respectively. The central processing signal 5 compares SGL and SGR with a minimum threshold to see whether or not both SGL and SGR are greater than the minimum threshold. If both are less than the minimum threshold, the central processing unit 5 decides that the inquiry results in failure. On the other hand, if at least one of SGL and SGR is equal to or greater than the minimum threshold, the central processing unit 5 multiplies the smaller binary number SGR or SGL with the larger binary number SGL or SGR by a predetermined coefficient "K", and compares the product "SGL×K" or "SGR×K" with SGR or SGL to see whether or not the larger binary number is greater than the product.

When SGL is greater than the product "SGR×K", the central processing unit 5 locates the missing remote controller 30 in the sub-space AGL. On the other hand, when the SGR is greater than the product "SGL×K", the central processing unit 5 locates the missing remote controller 30 in the sub-space AGR. However, if SGL or SGR is equal to or less than the product "SGR×K" or "SGL×K", the answers are given negative, and the central processing unit 5 locates the missing remote controller 30 in the sub-space AGM. The sub-spaces AGL, AGM and AGR have been already assigned the tone at the pitches equal to that of the white keys LK1, MK1 and HK1 (see FIG. 4), respectively. The relation between the results of the comparison and the sub-space is summarized in FIG. 5.

Subsequently, the central processing unit 5 estimates the distance from the electronic piano 20 to the missing remote controller 30 on the basis of the received power. The central processing unit 5 compares the larger binary number SGL or SGR with a low threshold and a high threshold to see how long the missing remote controller 30 is spaced from the electronic piano 20. The low threshold is greater than the minimum threshold, and is less than the high threshold. If the larger binary number SGR or SGL is less than the low threshold, the central processing unit 5 decides that the missing remote controller 30 is spaced far from the electronic piano 20, and adjust the tone to be produced at a small value of loudness "pp". On the other hand, if the larger binary number SGR or SGL is greater than the high threshold, the central processing unit 5 decides that the missing remote controller 30 is close to the electronic piano 20, and adjusts the tone to be produced at a large value of loudness "ff". When the larger binary number SGR or SGL is greater than the low threshold and less than the high threshold, the central processing unit 5 decides that the missing remote controller 30 is to be found at the middle range, and adjusts the tone to be produced at a middle value of loudness "mf". The relation between the distance and the loudness is also summarized in FIG. 5.

When the central processing unit 5 decides the possible location of the missing remote controller 30, the central processing unit 5 notifies the user of the possible location through the electronic tone. In detail, the central processing unit 5 produces the music data codes representative of the note-on, key code assigned to the white key LK1, MK1 or HK1 (see FIG. 4) and the loudness. The central processing unit 5 stores the music data codes in the random access memory 7, and sets the data source/destination flags representative of the random access memory 7 and the tone generator 15. Of course, the central processing unit 5 further produces the music data codes representative of the note-off and the key code, and stores the music data codes in the random access memory 7. The music data codes representative of the note-off are transferred to the tone generator 15 upon expiry of a certain time period after the data transfer of the music data codes representative of the note-on.

Upon completion of the jobs, the central processing unit 5 returns to the main routine program, and transfers the music data codes to the tone generating sub-system. As described hereinbefore, the central processing unit 5 checks the data source/destination flags for the music data codes during the execution in the main routine program. The music data codes have been already stored in the random access memory 7, and the data source/destination flags have been set. Then, the central processing unit 5 transfers the music data codes from the random access memory 7 to the tone generator 15. The tone generator 15 produces the audio signal on the basis of the music data codes representative of the note-on, key code and loudness, and the audio signal is converted to the electronic tone by means of the loud speakers 17*a*.

The user hears the electronic tone, and determines the possible location. The user measures the distance from the electronic piano 20 with eyes, and looks for the missing remote controller 30 in the sub-space AGL, AGM or AGR.

As will be understood from the foregoing description, the electronic system 20*d* compares the received power at the left antenna 21L with the received power at the right antenna 21R to see whether or not the missing remote controller 30 is to be found any one of the sub-spaces around the electronic piano 20, and notifies the user of the possible location of the missing remote controller 30. Even if the missing remote controller 30 is hidden under something, the user can hear the notice from the electronic piano 20, and easily locates the missing remote controller 30. Since the user instructs the electronic piano 20 to locate the missing remote controller 30 with the keys LK1, LK2, LK3 and 27 on the electronic piano 20, the user can establish the electronic system 20*d* in the remote controller locating mode without any assistance of the remote controller 30.

Second Embodiment

Figure 6:
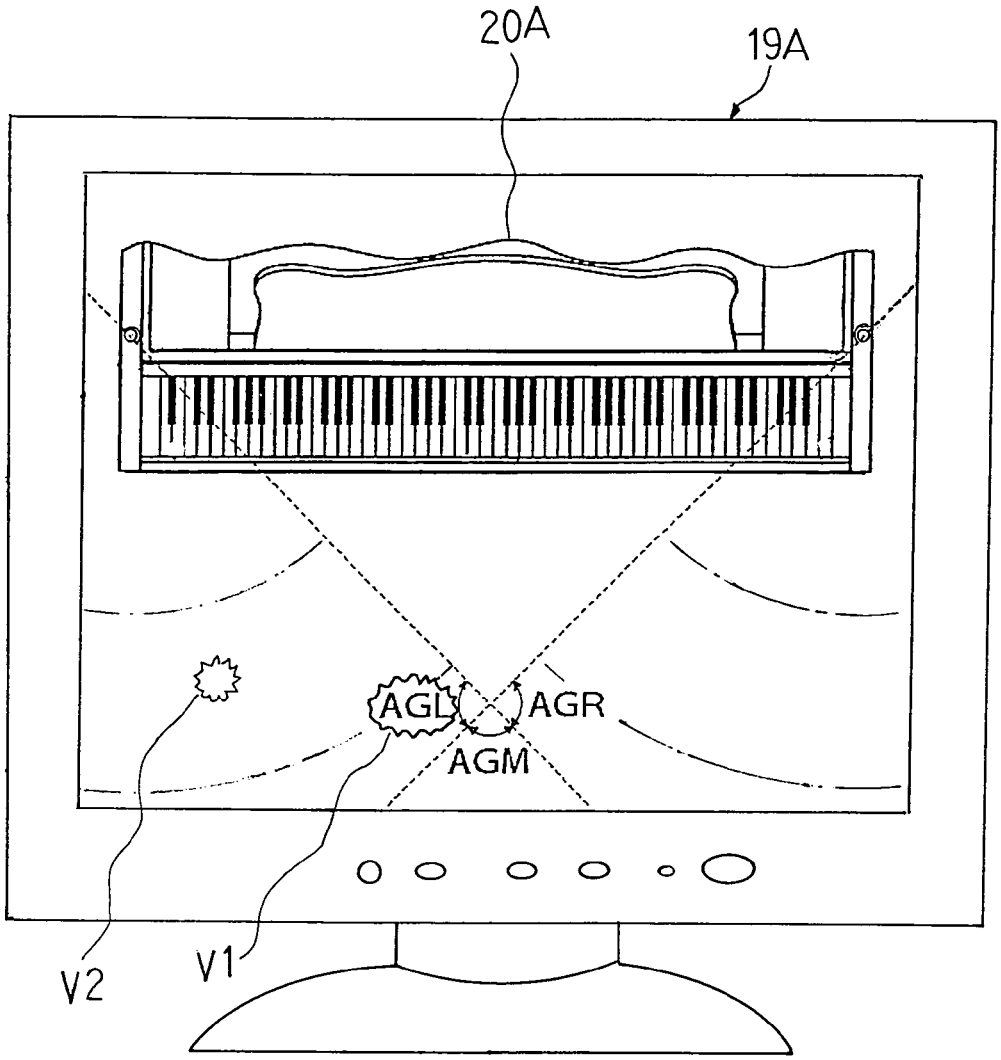
FIG. 6 is a front view showing visual images of the possible location produced on a display unit forming a part of an electronic piano of another musical instrument system according to the present invention.

Referring to FIG. 6 of the drawings, the sub-spaces AGL/AGM/AGR are produced on a display unit 19A together with a visual image of an electronic piano 20A. The electronic musical instrument system implementing the second embodiment also largely comprises the electronic piano 20A and a remote controller (not shown). The electronic piano 20A and remote controller are similar to the electronic piano 20 and remote controller 30 except for a conditional sub-routine program to be executed in the remote controller locating mode. For this reason, other system components of the electronic piano 20A and circuit components of the remote controller are labeled with the references designating the system components of the first embodiment shown in FIGS. 1 to 3. The display unit 19A is incorporated in the electronic system 20*d*, and the associated display controller 9 produces visual images such as those illustrated in FIG. 6 on the display unit 19A.

The conditional sub-routine program is hereinafter described in detail. When a user instruct the electronic system 20*d* to locate the missing remote controller 30, the central processing unit 5 sets the mode flag representative of the remote controller locating mode, and the main routine program branches to the conditional sub-routine program. The central processing unit 5 makes the remote controller 30 to radiate the radio wave representative of the annunciation, and analyzes the received power at both antennas 21L/21R as similar to the central processing unit 5 of the first embodiment.

Upon completion of the analysis, the central processing unit 5 produces control data codes representative of the visual images of the sub-areas AGL/AGM/AGR around the electronic piano 20A and visual images V1 and V2 of flicks representative of the possible sub-space and distance from the electronic piano 20A, and stores the control data codes in the random access memory 7. The central processing unit 5 sets the data source/destination flags, and returns to the main routine program.

The central processing unit 5 checks the data source/destination flags, and transfers the control data codes from the random access memory 7 to the display controller 9. The display controller 9 produces the visual images on the display unit 19A as shown in FIG. 6. In this instance, the flick image V1 is indicative of the sub-space AGL, and the other flick image V2 teaches that the missing remote controller 30 will be found at the middle range.

As will be understood from the foregoing description, the electronic system 20*d* notifies the user of the possible location of the missing remote controller 30 through the visual images so that the user can easily find the missing remote controller 30.

Third Embodiment

Figure 7:
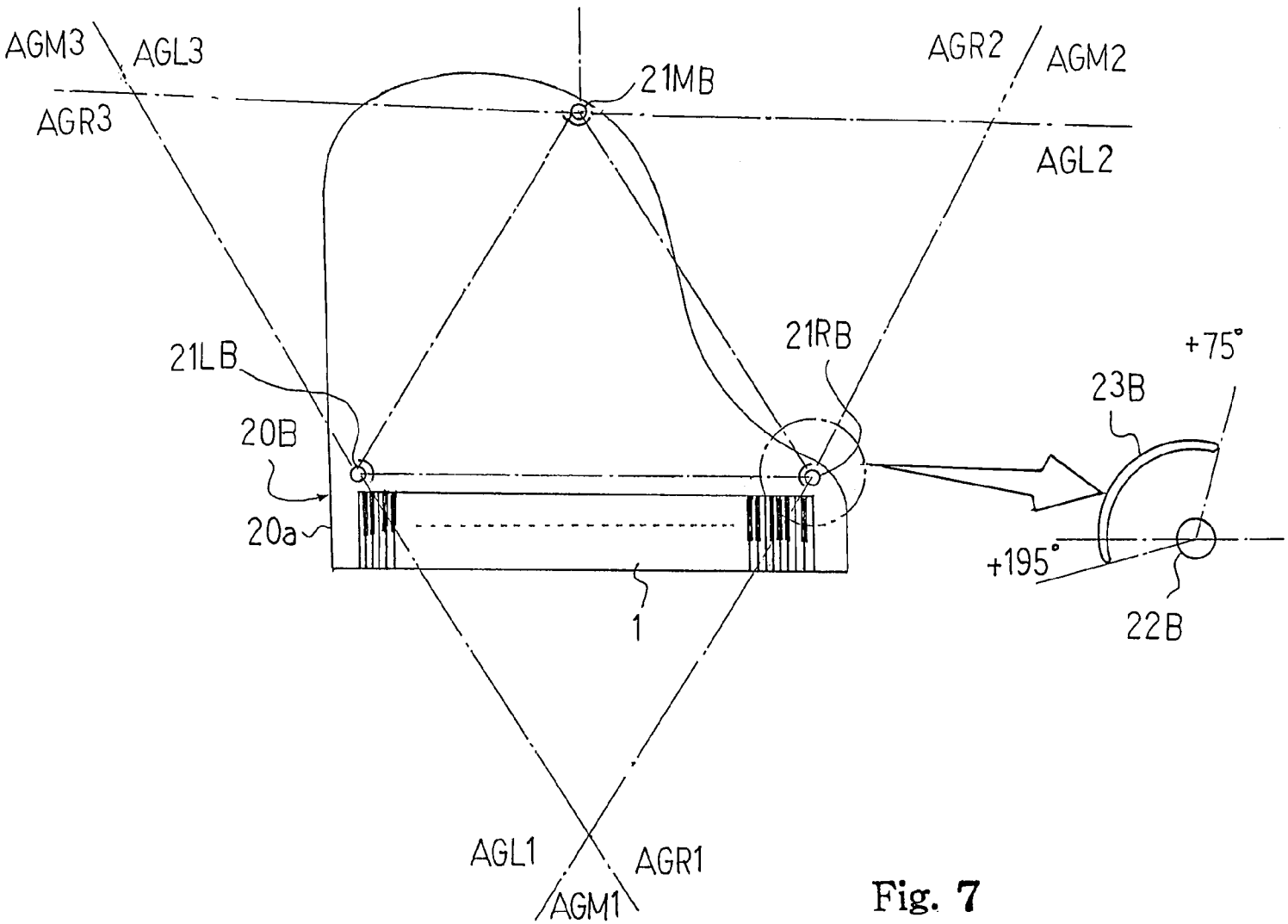
FIG. 7 is a plan view showing sub-spaces defined around an electronic piano of yet another musical instrument system according to the present invention.

Turning to FIG. 7 of the drawings, yet another musical instrument system embodying the present invention includes an electronic piano 20B and a remote controller (not shown). The remote controller (not shown) is same as the remote controller 30, and the component parts of the remote controller (not shown) are labeled with the references designating the corresponding component parts of the remote controller 30 shown in FIGS. 1 and 3. The electronic piano 20B is similar to the electronic piano 20 except antennas 21LB/21MB/21RB and a conditional sub-routine program to be executed in the remote controller locating mode. For this reason, other components of the electronic piano 20B are labeled with the references designating the corresponding components of the electronic piano 20 shown in FIGS. 1 and 2 without detailed description.

The left antenna 21LB, central antenna 21MB and right antenna 21RB are upright on the piano cabinet 20*a*, and are disposed at three vortexes of an equilateral triangle. Each of the three antennas 21LB/21MB/21RB includes an antenna pole 22B and a shield wall 23B. The shield wall 23B has a contour like a third of a pipe, and extends over 120 degrees, i.e . , from +75° to 195°. Extension lines of the equilateral triangle define nine sub-spaces AGL1/AGM1/AGR1,AGL2/AGM2/AGR2 and AGL3/AGM3/AGR3 as shown. The different tones are assigned to the nine sub-spaces AGL1/AGM1/AGR1,AGL2/AGM2/AGR2 and AGL3/AGM3/AGR3.

When a user instructs the electronic system 20*d* to locate the missing remote controller (not shown), the central processing unit 5 supplies the control data code representative of the inquiry to the radio transmitter/receiver 11, and the radio wave is radiated from the antennas 21LB/21MB/21RB. The remote controller (not shown) captures the radio wave representative of the inquiry at the antenna 33*r*, and transmits the radio wave representative of the annunciation toward the electronic piano 20B.

The radio wave representative of the annunciation is captured at the left, central and right antennas 21LB/21MB/21RB. However, the received power is varied depending upon the direction and distance of the missing remote controller (not shown). The radio transmitter/receiver 11 demodulates the radio wave captured at the antennas 21LB/21MB/21RB to a left annunciation signal, a center annunciation signal and a right annunciation signal, and produces control data codes representative of the magnitude of the left, center and right annunciation signals.

The central processing unit 5 fetches the control data codes, and analyzes the binary values in a similar manner to that described in conjunction with the first embodiment. The central processing unit 5 determines the possible location of the missing remote controller, and estimates the distance as the results of the analysis. The central processing unit 5 produces the music data codes representative of one of the sub-spaces AGL1/AGM1/AGR1, AGL2/AGM2/AGR2 and AGL3/AGM3/AGR3 and the distance from the electronic piano 20B. The central processing unit 5 stores the music data codes in the random access memory 7, and sets the data source/destination flags.

Upon completion of the jobs, the central processing unit 5 returns to the main routine program, and transfers the music data codes to the tone generator 15. The tone generator 15 produces the audio signal on the basis of the music data codes, and supplies the audio signal through the sound unit to the loud speakers 17*a*. Thus, the electronic system 20*d* notifies the user of the possible location of the missing remote controller and distance from the electronic piano 20B.

The space around the electronic piano 20B is divided into the nine sub-spaces AGL1/AGM1/AGR1, AGL2/AGM2/AGR2 and AGL3/AGM3/AGR3, and the central processing unit 5 selects one of the nine sub-spaces AGL1/AGM1/AGR1, AGL2/AGM2/AGR2 and AGL3/AGM3/AGR3 as the possible location. The user looks for the missing remote controller in a narrow sub-space so that he or she finds it within a short time period.

Although particular embodiments of the present invention have been shown and described, it will be apparent to those skilled in the art that various changes and modifications may be made without departing from the spirit and scope of the present invention.

For example, the user may be notified of only the distance between the musical instrument 20 and the remote controller 30. In this instance, the received power is compared with several thresholds, which are corresponding to the distance, so that the jobs in the remote controller locating mode are simpler than those of the first embodiment are. In another modification, the electronic system 20*d* determines only the sub-space where the missing remote controller is possibly found. The jobs are also simpler than those of the first embodiment are.

The location of the antennas 21L/21R does not set any limit to the technical scope of the present invention. The antennas 21L/21R may be put on a top board of the piano cabinet 20*a*. Thus, the antennas 21L/21R are put in any areas on the piano cabinet 20*a* in so far as the areas are spaced from one another.

The tones LK1/MK1/HK1, which are respectively selected from the low, middle and high registers, do not set any limit to the technical scope of the present invention. The sub-spaces may be specified with a certain tone, another tone one octave higher than the certain tone and yet another tone two octaves higher than the certain tone. Otherwise, the sub-spaces may be specified with different tones selected from the low register, middle register or high register, respectively.

In the first embodiment, the central processing unit 5 selects one of the three sub-spaces AGL/AGM/AGR where the missing remote controller 30 would be found. Even though the missing remote controller 30 is in the sub-space confronted with the sub-space AGM, the missing remote controller 30 is locatable, because the strength of the radio wave is minimum at both antennas 21L/21R. In other words, although the difference in strength of the radio wave propagated through the non-labeled sub-space is also negligible between the left antenna 21L and the right antenna 21R, the radio wave propagated through the non-labeled sub-space is much weaker than the radio wave propagated through the sub-space AGM. If the central processing unit 5 determines the strength of the radio wave propagated through the sub-space AGM and stores it in the random access memory 7, it is possible to discriminate the radio wave propagated through the non-labeled sub-space from the radio wave propagated through the sub-space AGM.

The flasher 35 and sound generator 34 do not set any limit to the technical scope of the present invention. Even if the advisory sound and light are not produced, the user can find the remote controller with the assistance of the tone or visual image specifying the location of the remote controller.

The entry keys LK1/LK2/LK3 do not set any limit to the technical scope of the present invention. One of the switches 2 may be assigned the remote controller locating mode. Otherwise, the entry keys LK1/LK2/LK3 may be replaced with the pedal. When a user wishes to look for the missing remote controller, he or she pushes the switch, or turns on the power switch 27 after stepping on the pedal. Then, the electronic piano is established in the remote controller locating mode. Otherwise, when a user turns on the power switch, the electronic piano may automatically enter the remote controller locating mode. If the electronic piano is equipped with a voice recognition system, the user gives the instruction to the electronic system through his or her voice message. When the user sequentially depresses the black/white keys 1*a*/1*b* for a predetermined music passage, the electronic system may be established in the remote controller locating mode. In yet another musical instrument system, the user gives a command to the electronic system.

The inquiry does not set any limit to the technical scope of the present invention. The remote controller 30 may periodically transmits the radio wave representative of the annunciation to the electronic piano 20/20A/20B without any inquiry. In detail, the timer 38 measures a predetermined time period (see FIG. 3), and triggers the signal generator 39 upon expiry of the predetermined time period. Then, the signal generator 39 supplies the output signal representative of the annunciation to the transmitter 41, and the radio wave is transmitted from the antenna 33*s* to the electronic piano 20/20A/20B. The central processing unit 5 analyzes the control data codes, and determines the possible sub-space and distance from the electronic piano 20/20A/20B. In this instance, the notice through the visual images is preferable to the notice through the tones. Otherwise, the central processing unit 5 stores the data codes representative of the possible sub-space and distance in the random access memory 7, and periodically renews the pieces of data information. When the user requests the electronic system 20*d* to locate the missing remote controller, the central processing unit 5 produces the music data codes representative of the possible sub-space and distance, and supplies them to the tone generator 15 so as to notify the user of the possible location of the missing remote controller. The user may switch off the notice through the tones. In this instance, when the user looks for the missing remote controller, he or she switches on the notice through the tones.

The analysis on the basis of the ratio in received power between the antennas does not set any limit to the technical scope of the present invention. The central processing unit may determine the possible location on the basis of the difference in received power between the antennas.

The radio wave does not set any limit to the technical scope of the present invention. Ultrasonic wave is available for the communication from the remote controller and the electronic piano. In this instance, the central processing unit 5 may determine the possible sub-space on the basis of the difference in arrival time between the antennas. Infrared light is also available for the communication between the electronic system 20*d* and the remote controller 30.

The relative position between the antenna pole and the shield wall does not set any limit to the technical scope of the present invention. A pair of shield walls may be provided on the left side and right side of the antenna pole. In this instance, the antenna pole can capture the radio wave propagated through the rear space so that a sub-space or sub-spaces are defined at the back of the electronic piano.

The antenna, which consists of the antenna pole and shield wall, does not set any limit to the technical scope of the present invention. In case where an antenna pole is well sensitive to the direction of the radio wave, the shield wall is eliminated from the antenna. The plural antennas may be replaced with a single directionally sensitive antenna pole. Otherwise, the single antenna pole may turn for searching all the directions around the electronic piano.

The pitch and loudness of the tone do not set any limit to the technical scope of the present invention. The electronic system 20*d* may notify the user of the possible sub-space and distance through any two of the pitch, loudness, tone color, effect and time period over which the tone is continuously produced.

The electronic system 20*d* may notify the possible location of the missing remote controller through the tone radiated from the headphone 17*b*. Another electronic system may notify the user of the possible location through a short music passage, a voice message, a light beam, illumination or vibrations of pedals. The short music passage is changed depending upon the possible sub-space and/or distance.

The electronic system 20*d* may notify the user of the possible location of the remote controller only when the flicks and advisory sound do not draw the user's attention to the missing remote controller. In detail, when the remote controller receives the first inquiry, the flasher 35 and sound generator 34 radiate the light and advisory sound, and the timer starts without any annunciation. If the second inquiry reaches the remote controller within a predetermined time period, the signal generator 39 transmits the output signal representative of the annunciation to the electronic piano. Moreover, if the possible location is same as that at the previous inquiry, the electronic system 20*d* keeps itself silent. Thus, the user is prevented from the disturbance due to the excessively repeated notice.

The electronic system 20*d* may notify the user of the possible location of the missing remote controller upon expiry of a short time period after the generation of the advisory sound and light. This feature is desirable, because the user can discriminate the tones from the advisory sound.

The IEEE 802.11b standard does not set any limit to the technical scope of the present invention. The communication may be carried out on the basis of other communication protocols such as, for example, Bluetooth (trademark), Home Radio Frequency (trademark) and so forth. The communication protocols may be different from the communication between the system components for the tone generation.

The electronic piano does not set any limit to the technical scope of the present invention. The present invention is applicable to other sorts of electronic/electric musical instruments such as, for example, electronic strings, electronic percussion instruments and electric/electronic music boxes in so far as the electric/electronic musical instruments are controllable with remote controllers. The electric piano includes a keyboard and a tone generating sub-system connected to the keyboard and responsive to fingering on the keyboard for producing electric tones.

The present invention is further applicable to acoustic musical instruments such as, for example, pianos, percussion instruments, wind instruments and stringed instruments. Certain models of acoustic pianos are equipped with display units where directions of tutor and/or music scores are produced, and messages and instructions are heard from the built-in loud speaker. The percussion instruments, wind instruments and stringed instruments are also equipped with the display units. Although the display unit is controllable through a manipulating panel, a remote controller may be prepared for user's convenience. Users may wish to hear the directions of tutor on a sofa remote from the acoustic musical instrument. In this situation, the users appreciate the remote controllers. Thus, the present invention is applicable to the acoustic musical instruments.

The present invention is further applicable to composite musical instruments such as, for example, automatic player pianos and mute pianos.

Figure 8:
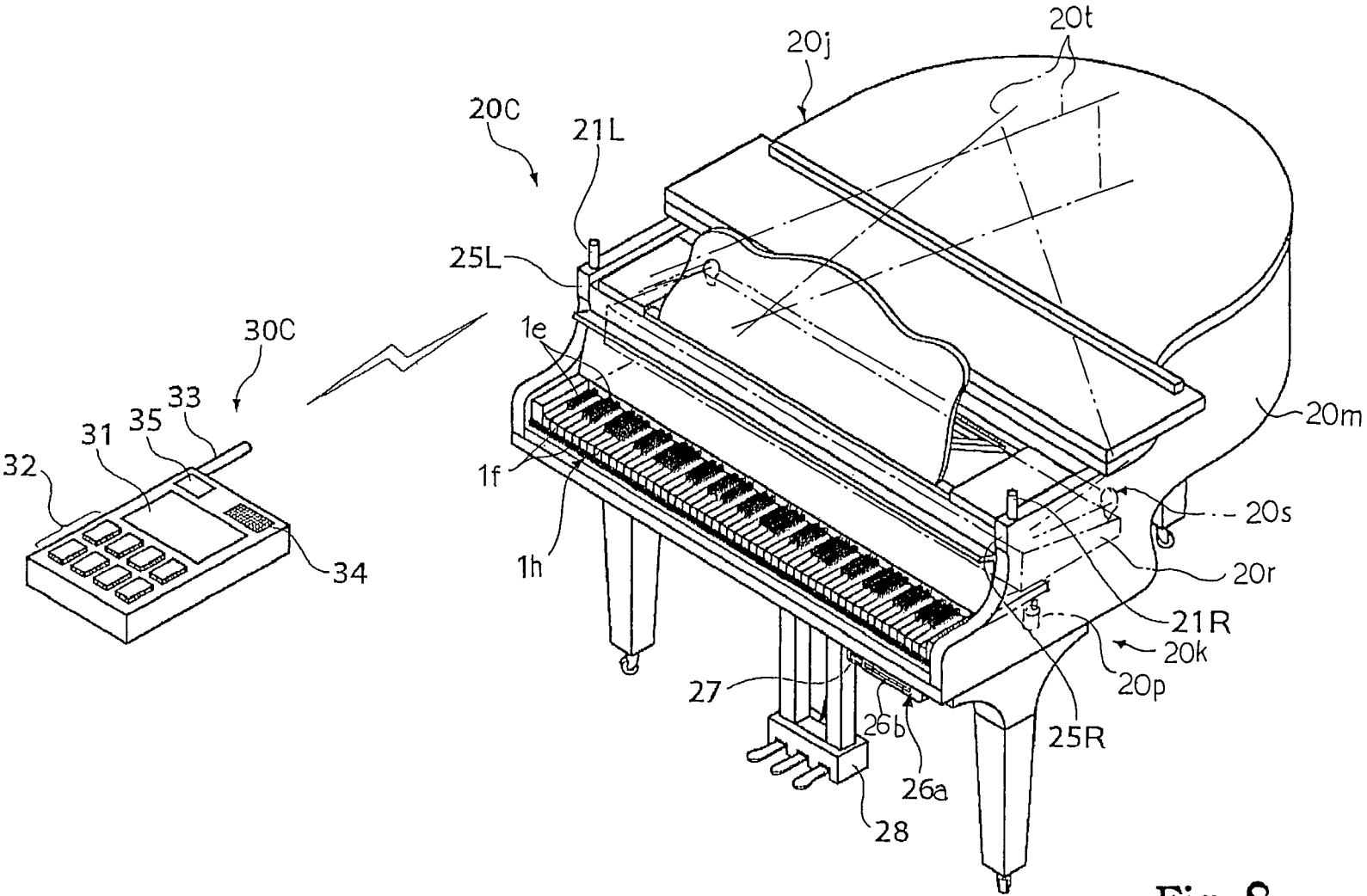
FIG. 8 is a perspective view showing still another musical instrument system according to the present invention.

The automatic player piano is also built up on the basis of a grand piano or an upright piano. FIG. 8 shows an automatic player piano 20C built up on the basis of a grand piano 20*j*. Component parts of the automatic player piano 20C corresponding to those of the above-described embodiments are labeled with reference characters designating the corresponding component parts of the above-described embodiments. Black keys 1*e* and white keys 1*f* are incorporated in a keyboard 1*h*. An automatic playing system 20*k* is installed in the piano cabinet 20*m*. A controller 26*a* and solenoid-operated key actuators 20*p* form essential parts of the automatic playing system 20*k*. The controller 26*a* analyzes music data codes, which have been already supplied from a suitable information storage medium, and determines the keys 1*e*/1*f* to be depressed and timing at which the keys start to sink through the data analysis. When the time comes, the controller 26*a* selectively supplies driving signals to the solenoid-operated key actuators 20*p* at appropriate timing so that the solenoid-operated key actuators 20*p* move the associated keys 1*e*/1*f* without any fingering on the keyboard 1*h*. Associated action units 20*r* are activated, and drive hammers 20*s* for rotation. The hammers 20*s* strike strings 20*t* for generating acoustic piano tones. Thus, the automatic player piano 20C can perform a piece of music without any fingering of a human player.

Users give instructions to the automatic playing system 20*k* through a manipulating panel 26*b* and a remote controller 30C. A data processing sub-system is shared with the automatic playing system, and is connected to a radio transmitter/receiver. Plural antennas 21L/21R, which are spaced from one another, are connected to the radio transmitter/receiver, and the radio wave, which is transmitted from the remote controller 30C, is captured at the antennas 21L/21R. The data processing sub-system behaves in the remote controller locating mode as similar to that of the electronic piano 20. Thus, the present invention is applicable to the automatic player pianos 20C. When the data processing sub-system notifies the user of the possible location, selected one of the solenoid-operated actuators 20*p* pushes the associated key 1*e*/1*f* for producing the tone at the predetermined pitch. This feature is desirable, because the user confirms the possible location by means of the key 1*e*/1*f* moved by the solenoid-operated key actuator 20*p*.

Figure 9:
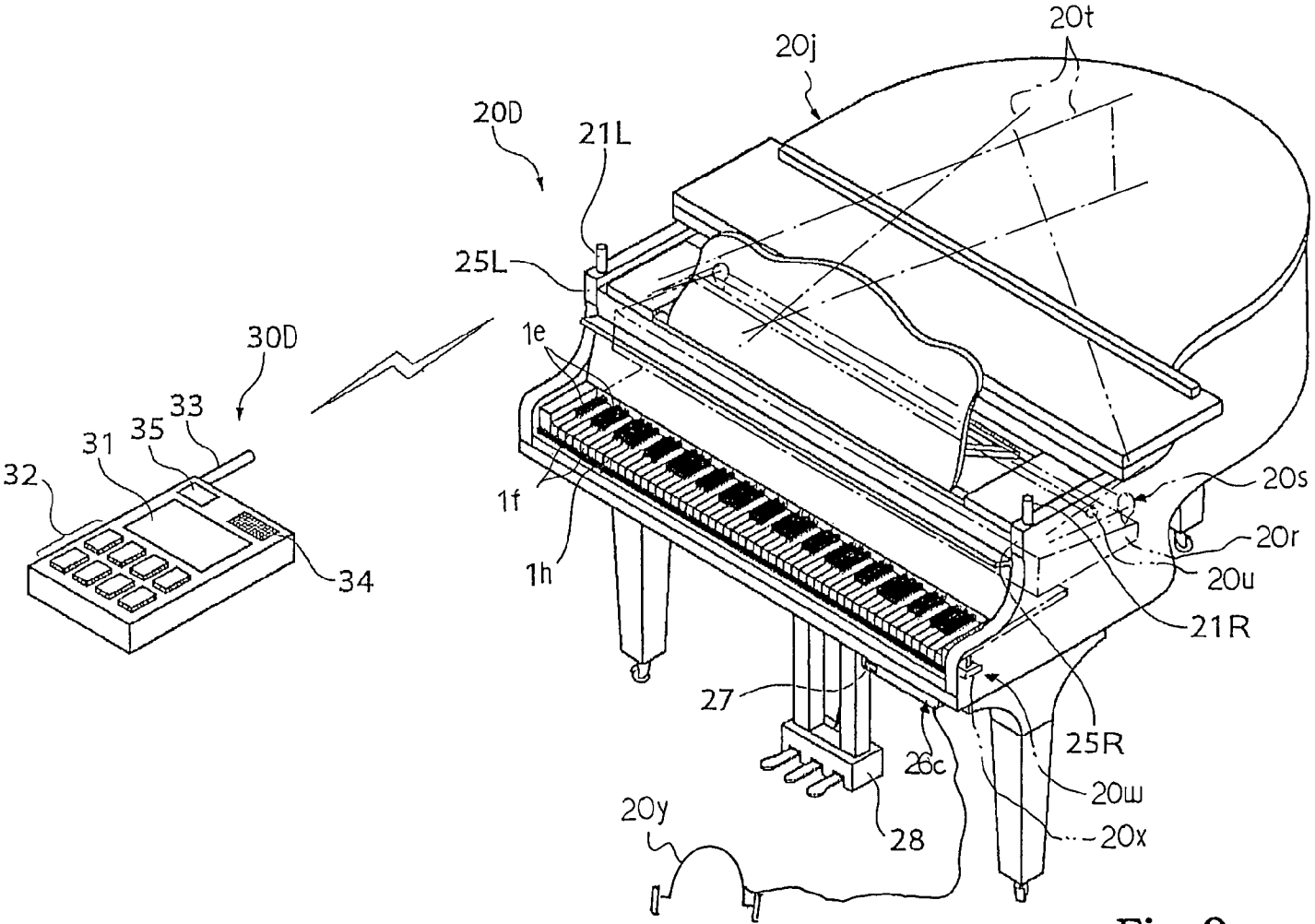
FIG. 9 is a perspective view showing yet another musical instrument system according to the present invention.

The mute piano 20D is a combination of the acoustic piano 20*j* as shown in FIG. 9, a hammer stopper 20*u* and an electronic tone generating system 20*w*. Component parts of the mute piano 20D corresponding to those of the above-described embodiments are labeled with reference characters designating the corresponding component parts of the above-described embodiments. The hammer stopper 20*u* is changed between a free position and a blocking position. While the hammer stopper 20*u* is staying in the free position, the strings 20*t* are struck with the hammers 20*s* at the end of the free rotation, and the acoustic piano tones are generated through the vibrations of the strings 20*t*. When the hammer stopper 20*u* is changed to the blocking position, the hammer stopper 20*u* enters the trajectories of the hammers 20*s*. Although the hammers 20*s* are driven for the free rotation, the hammers 20*s* rebound on the hammer stopper 20*u* before the end of the free rotation, and any acoustic piano tone is not produced. The electronic tone generating system 20*w* monitors the keys 1*e*/1*f* selectively depressed and released by the player by means of key sensors 20*x*, and electronically produces tones at pitches equal to the pitches assigned to the depressed keys 1*e*/1*f*. The electronic tones are radiated from a headphone 20*y* so that the user can enjoy his or her performance on the keyboard 1*h* without disturbing the neighborhood.

Users give instructions to the electronic tone generating system 20*w* through a manipulating panel 26*c* and a remote controller 30D. A data processing sub-system is shared with the electronic tone generating system 20*w*, and is connected to a radio transmitter/receiver. Plural antennas 21L/21R, which are spaced from one another, are connected to the radio transmitter/receiver, and the radio wave, which is transmitted from the remote controller 30D, is captured at the antennas. The data processing sub-system behaves in the remote controller locating mode as similar to that of the electronic piano 20. Thus, the present invention is applicable to the mute pianos 20D.

Claim languages are correlated with the components of the keyboard musical instrument system described with reference to the drawings as follows. The keyboard 1 and tone generating sub-system 20*h* as a whole constitute "sound generator". In the automatic player piano 20C, the keyboard 1*h*, action units 20*r*, hammers 20*s*, strings 20*t* and solenoid-operated key actuators 20*p* as a whole constitute "sound generator". The keyboard 1*h*, action units 20*r*, hammers 20*s*, strings 20*t* and electronic tone generating system 20*w* as a whole constitute "sound generator" in the mute piano 20D.

On the other hand, the antennas 21L/21R, radio transmitter/receiver 11 and data processing sub-system 20*f* form in combination "electric system". The controller 26*a* and antennas 21L/21R also serve as the "electric system".

The tone generating sub-system 20*h* serves as "information provider", and the display controller 9 and display unit 19A form in combination the "information provider". The keys 1*e*/1*f*, solenoid-operated actuators 20*p*, action units 20*r*, hammers 20*s* and strings 20*t* as a whole constitute "information provider".

Each of the antennas 21L/21R or 21LB/21MB/21RB serves as "reception point". The data processing sub-system 20*f* and tone generating sub-system 20*h* as a whole constitute "electric tone generating sub-system" in the electronic piano 20.

What is claimed is:

1. A musical instrument system for producing music sound, comprising:

a remote controller outputting instructions for a behavior and an annunciation representative of a present location to the outside thereof; and a musical instrument, physically separated from said remote controller, and including the following elements which are entirely distinct from the remote controller:

a sound generator for producing said music sound, an electric system responsive to said instructions so as to assist said sound generator in at least producing said music sound and analyzing said annunciation for locating said remote controller in a space around said musical instrument and an information provider connected to said electric system and notifying users of a possible location of said remote controller.

2. The musical instrument system as set forth in claim 1, in which said electric system determines a magnitude of said annunciation received, and locates said remote controller on the basis of said magnitude.

3. The musical instrument system as set forth in claim 2, in which said annunciation is transmitted from said remote controller and said electric system through a radio wave.

4. The musical instrument system as set forth in claim 3, in which said electric system determines a received power of said radio wave, and locates said remote controller on the basis of said magnitude.

5. The musical instrument as set forth in claim 4, in which a value of said received power is variable depending upon a direction of said remote controller with respect to said musical instrument so that said electric system determines at least said direction of said remote controller on the basis of said value of said received power.

6. The musical instrument system as set forth in claim 4, in which a value of said received power is variable depending upon a distance between said remote controller and said musical instrument so that said electric system determines at least said distance of said remote controller on the basis of said value of said received power.

7. The musical instrument system as set forth in claim 4, in which said electric system determines said received power of said radio wave at plural reception points on said musical instrument, and compares the values of said received power with one another for locating said remote controller on the basis of the result of the comparison.

8. The musical instrument system as set forth in claim 7, in which a value of said received power is variable at each of said plural reception points so that said electric system determines a sub-space where said remote controller is to be found on the basis of a combination of the values of said received power at said plural reception points.

9. The musical instrument system as set forth in claim 1, in which said information provider notifies said user of said possible location through an information medium selected from a group consisting of sound, tones, visual images, light, illumination, voice message, a music passage and motion of a component of said musical instrument.

10. The musical instrument system as set forth in claim 9, in which said information provider notifies said user of said possible location through another information medium selected from said group concurrently with said information medium.

11. The musical instrument system as set forth in claim 1, in which said remote controller is responsive to an inquiry transmitted from said electric system so as to output said annunciation.

12. The musical instrument system as set forth in claim 11, in which said remote controller further draws the attention of said user thereto by generating an information medium.

13. The musical instrument system as set forth in claim 12, in which said information medium is at least light.

14. The musical instrument system as set forth in claim 12, in which said information medium is at least advisory sound.

15. A musical instrument controllable with a remote controller physically separated therefrom, and comprising the following elements which are entirely distinct from the remote controller:

a sound generator for producing music sound;

an electric system responsive to instructions for a behavior of said musical instrument so as to assist said sound generator in at least producing said music sound and analyzing an annunciation supplied from said remote controller for locating said remote controller in a space around said musical instrument; and an information provider connected to said electric system and notifying users of a possible location of said remote controller.

16. The musical instrument as set forth in claim 15, in which said sound generator includes:

a keyboard having plural keys selectively depressed and released, and an electric tone generating sub-system connected to said keyboard and selectively producing tones at pitches equal to those assigned to the depressed keys.

17. The musical instrument as set forth in claim 16, in which said electric tone generating sub-system includes a data processing sub-system and a tone generating sub-system for producing electric tones on the basis of music data codes supplied from said data processing sub-system, and said data processing sub-system is shared with said electric system.

18. The musical instrument as set forth in claim 17, in which said electric system further includes an interface through which said data processing sub-system communicates with at least said remote controller.

19. The musical instrument as set forth in claim 18, in which said interface includes a radio receiver for receiving a radio wave carrying said annunciation.

20. The musical instrument as set forth in claim 19, in which said radio receiver is connected to plural antennas spaced from each other so that said radio wave is captured at said plural antennas, and a received power of said radio wave is variable at each of said plural antennas depending upon a location of said remote controller so that said data processing sub-system determines a sub-space in said space where said remote controller is to be found on the basis of a combination of values of said received power at said plural antennas.

21. The musical instrument as set forth in claim 20, in which said data processing sub-system determines at least a direction of said remote controller with respect to said plural antennas on the basis of said combination.

22. The musical instrument as set forth in claim 20, in which said data processing sub-system determines at least a distance between said remote controller and one of said plural antennas on the basis of one of said values of said received power.

23. The musical instrument as set forth in claim 15, in which said sound generator includes a keyboard having plural keys selectively depressed and released, plural action units respectively connected to said plural keys and actuated by the depressed keys, and plural hammers driven for rotation by said plural action units, respectively, plural strings respectively struck with said plural hammers at the end of said rotation for generating acoustic tones.

24. The musical instrument as set forth in claim 23, in which said sound generator further includes plural key actuators causing said plural keys to move without fingering of a human player under the control of a controller of an automatic playing system, and a data processing sub-system is shared between said controller and said electric system for analyzing said annunciation.

25. The musical instrument as set forth in claim 24, in which selected ones of said plural key actuators, the keys associated with said selected ones of said plural key actuators, the action units linked with said keys, the hammers driven for rotation by said action units and the strings to be struck with said hammers form in combination said information provider.

26. The musical instrument as set forth in claim 23, further comprising a hammer stopper changed between a free position for permitting said plural hammer to strike said plural strings and a blocking position for causing said plural hammers to rebound thereon before striking said plural strings, and an electronic sound generating system responsive to said plural keys selectively depressed and released so as to produce electric tones and having a data processing sub-system shared between said electric system.

27. The musical instrument as set forth in claim 15, in which said information provider includes an electric tone generating sub-system shared with said sound generator so that said user is notified of said possible location through electric tones.

28. The musical instrument as set forth in claim 15, in which said information provider includes a display controller connected to said electric system and a display unit for producing visual images, and said electric system supplies pieces of visual data representative of said possible location to said display controller for producing visual images on said display unit.

29. A method performed by a musical instrument capable of producing predetermined tones for locating a remote controller which is physically separate from the musical instrument and is located in a space around the musical instrument, the method comprising the steps of:

a) receiving an annunciation indicative of a present location of said remote controller;

b) analyzing a physical quantity represented by said annunciation in terms of directions around said musical instrument for determining a possible location of said remote controller; and c) notifying a user of said possible location of said remote controller.

30. The method as set forth in claim 29, in which said step b) includes the sub-steps of b-1) determining values of said physical quantity at plural reception points spaced from one another, b-2) comparing said values with one another to see whether or not one of said values is much greater than the others of said values, b-3) selecting one of a plurality of sub-spaces of said space on the basis of a negative answer given at said sub-step b-2) or a combination of a maximum value and other values when an answer at said sub-step b-2) is given positive, and b-4) determining said possible location in said one of said sub-spaces.

31. The method as set forth in claim 30, in which said maximum value is compared with thresholds for determining a distance to said remote controller in said sub-step b-3).

32. The method as set forth in claim 29, in which said step a) includes the sub-steps of a-1) transmitting an inquiry from said musical instrument to said remote controller, and a-2) responding to said inquiry so that said remote controller transmits said annunciation to said musical instrument so that said musical instrument receives said annunciation.

33. The method as set forth in claim 29, in which said step c) includes the sub-steps of c-1) producing pieces of music data representative of one of said predetermined tones representative of said possible location, c-2) supplying said pieces of music data to a tone generator incorporated in said musical instrument, and c-3) producing said one of said predetermined tones on the basis of said pieces of music data so that said user is notified of said possible location through said one of said predetermined tones.

34. The method as set forth in claim 29, in which said step c) includes the sub-steps of c-1) producing pieces of visual data representative of a space around said musical instrument and said possible location in said space, c-2) supplying said pieces of visual data to a display controller, and c-3) producing said visual images from said pieces of visual data on a display provided in the vicinity of said musical instrument.

* * * * *